US007073981B2

(12) United States Patent
Wilson et al.

(10) Patent No.: US 7,073,981 B2
(45) Date of Patent: Jul. 11, 2006

(54) ROCK STABILIZER

(76) Inventors: Walter Baillie Wilson, P.O. Box 25, Paardekraal, 1752 (ZA); Mark Howell, P.O. Box 25, Paardekraal, 1752 (ZA); Frans Roelof Petrus Pienaar, P.O. Box 25, Paardekraal, 1752 (ZA)

( * ) Notice: Subject to any disclaimer, the term of this patent is extended or adjusted under 35 U.S.C. 154(b) by 0 days.

(21) Appl. No.: 10/903,791

(22) Filed: Jul. 30, 2004

(65) Prior Publication Data

US 2005/0053428 A1 Mar. 10, 2005

(30) Foreign Application Priority Data

Aug. 1, 2003 (ZA) ..... 2003/5955
Jan. 15, 2004 (ZA) ..... 2004/0302

(51) Int. Cl.
*E21D 21/00* (2006.01)

(52) U.S. Cl. ..... 405/259.4; 405/259.5; 411/78

(58) Field of Classification Search ..... 405/259.1, 405/259.3, 259.4, 259.5; 411/76, 78
See application file for complete search history.

(56) References Cited

U.S. PATENT DOCUMENTS 2,690,693 A * 10/1954 Campbell ..... 411/16
2,748,594 A * 6/1956 Edwards ..... 411/76
3,844,194 A * 10/1974 Reinwall, Jr. ..... 411/76
4,275,637 A * 6/1981 Herb et al. ..... 411/78
4,293,244 A * 10/1981 Donan, Jr. ..... 405/259.4
4,427,327 A * 1/1984 Herb ..... 411/78
5,112,160 A * 5/1992 Jensen et al. ..... 405/259.5

* cited by examiner

*Primary Examiner*—Thomas B. Will
*Assistant Examiner*—Tara L. Mayo
(74) *Attorney, Agent, or Firm*—Norman E. Lehrer

(57) ABSTRACT

A rock stabilizer includes a metal tube with a tapered distal end and a flanged proximal end capable of being positioned within a bore in a mine wall. A slit runs substantially the entire length and indentations are formed in the outer surface along the length adjacent the slit so that grout pumped into the interior of the tube flows out of the slit and into the indentations. An expander wedge within the tube adjacent the distal end is actuatable from the proximal end after the stabilizer is installed in a bore. The wedge expands the distal end of the tube to firmly anchor the stabilizer in the bore. The expander wedge is formed of one wedge welded to the interior of the tube and a second wedge moveable toward the fixed wedge. The two wedges are temporarily maintained together in the interior of the tube before actuation.

7 Claims, 2 Drawing Sheets

ROCK STABILIZER

BACKGROUND OF THE INVENTION

The present invention is directed toward a rock stabilizer and more particularly, toward a rock stabilizer that has increased holding strength and life expectancy.

Ground support, especially in the mining industry, is an important safety factor that must be taken into consideration during any type of excavating activity. Rock stabilizers, or rock bolts, have been used for many years to support exposed rock during mining operations. A number of types of rock bolts are used depending on the situation, such as ground conditions, costs, personal preferences, etc. There are three primary types of rock bolts. The first is an expansion shell type bolt where a screw threaded steel bar is inserted into a drilled hole in the rock. The bolt has a "shell" at its tip. Once the bolt is inserted into the drilled hole and is turned, the shell expands to the sides of the hole and grips the rock so that the steel bar can then be tensioned. This results in bolting the rock strata layers together.

Grouted bar type stabilizers are also known. These include a ribbed bar which is inserted into a drilled hole and which hole is then further filled with a specialized cement or resin-based grout. This type of support depends directly on the bond between the rock and the grout and the grout and the steel bar and acts like a reinforcing bar.

Another effective anchoring system that is currently used is commonly referred to as a split set. Such rock stabilizers include an elongated tube and a bearing plate. The tube is typically made from resilient steel and has a slit along its length so that the tube will be compressible for insertion into a pre-drilled bore in a mine roof or wall. One end of the tube is tapered and the other end has a ring flange. In order to install the split set, the bearing plate is placed against a surface to be supported, such as a wall or roof of a mine. The tapered end of the tube is then driven through the aperture and as the tube slides into place, the slot narrows. The tube exerts radial pressure against the surface over its full contact length and provides plate load support. The result is a tight grip brought about by the friction generated between the outer steel wall of the tube or cylinder and the inner side wall of the bore in the wall. Such systems are described, for example, in U.S. Pat. No. 5,295,768 to Buchhorn et al., U.S. Pat. No. 4,652,178 to Kates et al., U.S. Pat. No. 4,445,808 to Arya, and U.S. Pat. No. 4,382,719 to Scott.

The interior of these rock stabilizers can frequently corrode due to the steel being exposed to the atmosphere within the mine. Over time, this can limit the useful life of the stabilizer. It has been known, therefore, to fill the interior of the cylindrical rock stabilizer after it has been inserted into the bore with a grouting material. This helps not only to improve the useful life of the stabilizer but also to increase its holding strength.

Even further, and as described more fully in published PCT Application No. WO 99/05031 to Smith, it is also known to crimp the tube or form indentations or undulations at various places along the length of the stabilizer and which communicate with the open slip. These indentations allow the grout or other resinous material to extrude out of the interior of the stabilizer, through the slit and into the recessed area or undulation formed in the outer wall of the stabilizer. This allows more of the grout to come in contact with the bore hole and to increase the frictional holding of the stabilizer. The grout also helps to insulate the outer wall of the stabilizer from moisture to thereby increase the longevity thereof.

It is also known to utilize wedges within the rock stabilizer to increase the frictional holding thereof. This is accomplished by forcing a wedge-shaped member into the interior of the stabilizer after the stabilizer has been driven into place so that it can engage a portion of the interior wall of the stabilizer or another wedge-shaped member therein to expand a portion of the stabilizer wall to force it into contact with the interior wall of the bore. Examples of such devices are described in U.S. Pat. No. 4,312,605 to Fu et al. and published PCT Application No. WO 88/02437 to Hilton.

While the above-described systems are individually well known, no one has every recognized the advantages of combining them into an integrated system to gain all of the benefits thereof. Furthermore, while the wedge expanders of the prior art may be of some use, there are somewhat complex and difficult to employ in the field.

SUMMARY OF THE INVENTION

The present invention is designed to overcome the deficiencies of the prior art discussed above. It is an object of this invention to provide a rock stabilizer that has all of the advantages of the individual prior art systems.

It is a further object of the present invention to provide a rock stabilizer that combines the advantages of a grout filled tube with a wedge expander.

It is a still further object of the present invention to provide a rock stabilizer that includes a novel and more efficient wedge expander.

In accordance with the illustrative embodiments demonstrating features and advantages of the present invention, there is provided in a rock stabilizer that includes an elongated metal tube having and interior and an exterior surface with a distal end and a proximal end. The distal end is tapered and a flange is positioned adjacent the proximal end. The tube further includes a slit that runs substantially the entire length thereof. The tube is constructed so as to be capable of being positioned within a bore formed in the wall of a mine. A plurality of indentations or recesses are formed in the outer surface of the tube along the length thereof adjacent the slit so that grout or resinous material pumped into the interior of the tube can flow out of the slit and into the indentations or recesses. An expander wedge is also located within the interior of the tube adjacent the distal end and is actuatable from the proximal end of the tube after said stabilizer is installed in a bore. The wedge expands the distal end of the tube to firmly anchor the stabilizer in the bore. The expander wedge is formed of two wedges, one of which is welded to the interior of the tube and the other is capable of being moved toward the fixed wedge. The two wedges are temporarily maintained together while they are in the interior of the tube and before they are actuated.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
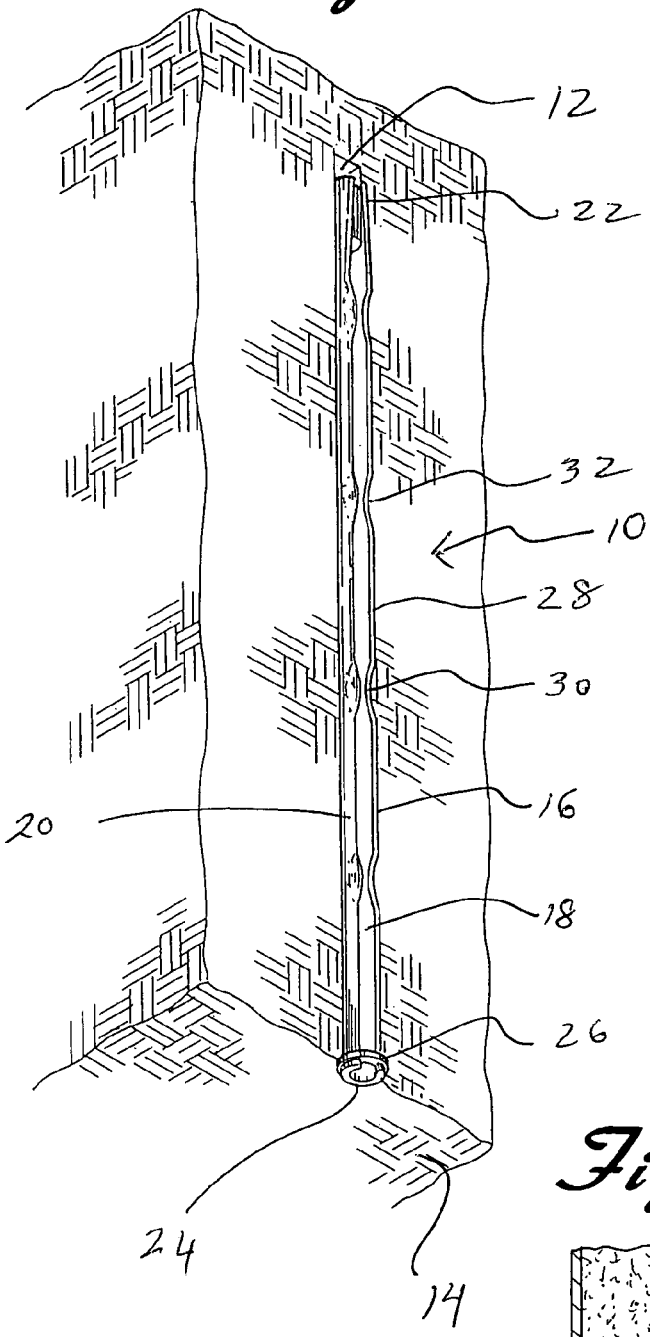
FIG. 1 is a perspective view shown partially in cross section of a rock stabilizer after the same has been driven into a bore formed in a mine wall or ceiling.

Referring now to the drawings in detail wherein like reference numerals have been used throughout the various figures to designate like elements, there is shown in FIG. 1 a rock stabilizer constructed in accordance with the principles of the present invention and designated generally as 10. FIG. 1 illustrates the rock stabilizer 10 after it has been forced into a bore 12 in the wall or ceiling 14 of a mine.

The rock stabilizer 10 is comprised essentially of an elongated substantially cylindrically shaped metal tube 16 having a hollow interior 18 and an exterior substantially cylindrically shaped surface 20. The tube 16 has a distal end 22 which is preferably tapered so as to be slightly smaller in diameter at the extreme end than throughout the remaining parts of the tube and a proximal end 24 including a flange 26. The tube 16 also includes a single slit 28 running substantially the entire length thereof.

The rock stabilizer 10 described to this point is, per se, known in the art. As is also well known, the diameter of the tube 16 is slightly greater than the diameter of the bore 12 in the mine ceiling 14. As a result, when the tube 16 is driven into the bore, the outer walls compress so as to create a frictional engagement between the rock stabilizer 10 and the interior wall of the bore 12.

As should also be readily apparent to those skilled in the art, before the rock stabilizer 10 is driven into the bore 12, a plate with an opening therein is normally passed around the tube 16 and is held in place by the flange 26. The plate prevents the rock stabilizer from being driven into the bore too far and also provides a means for hanging a lamp or securing accessories or the like to the mine ceiling. Again, such features are well known in the art.

Figure 6:
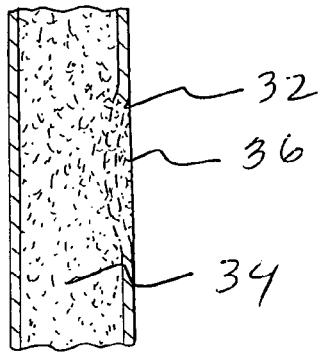
FIG. 6 is a cross sectional view of a portion of FIG. 5 showing the details of the grout extruding into a recess in the wall of the rock stabilizer.
Figure 5:
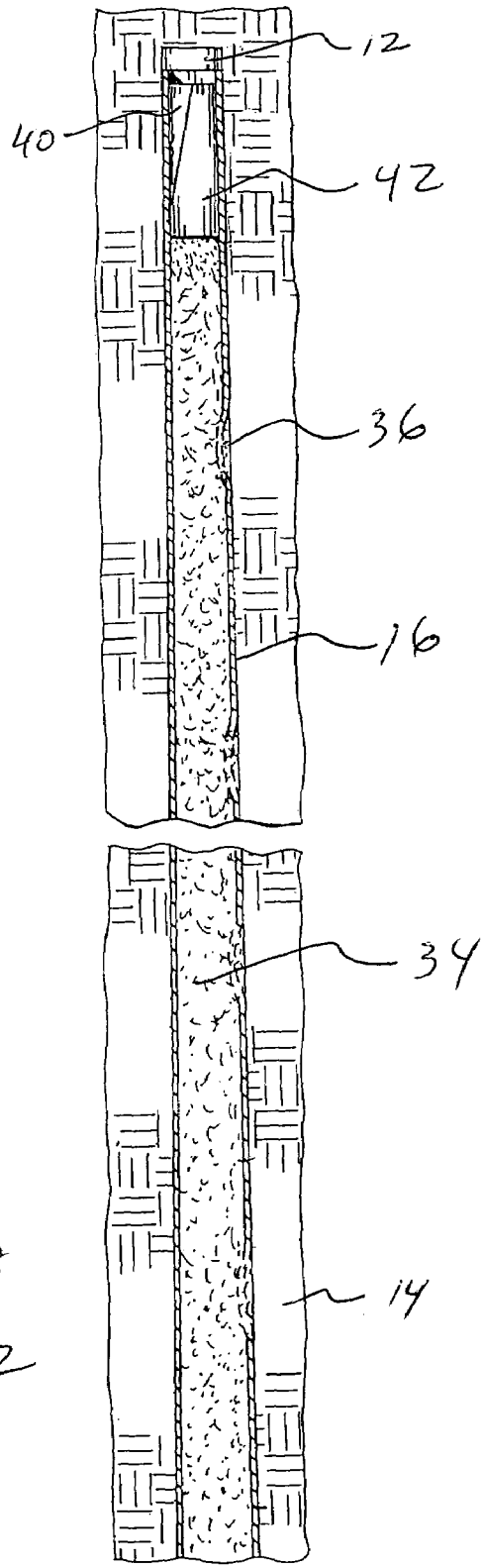
FIG. 5 is a cross-sectional view similar to FIG. 4 but showing the rock stabilizer after it has been filled with a grout material.

Preferably the outer surface of the tube 16 is also provided with a plurality of indentations or recesses such as shown at 30 and 32, etc., along the length of the tube 16. As best shown in FIGS. 1 and 5, the indentations or recesses are spaced apart from each other and are located at a plurality of different axial positions along the length of the tube. These indentations or recesses 30 and 32 lie adjacent the slit 28. In this way, once the rock stabilizer 10 is installed and grout or resinous material 34 is forced therein, the grout can extrude out through the slit and into the indentation 30 or 32 so as to lie on the exterior of the tube 16 to form a bond against the inner wall of the bore 12. This is shown most clearly in FIGS. 5 and 6 wherein a quantity of the grouting material 36 lies outside the interior 18 of the tube 16. This helps to secure the tube in place. The indentations or recesses such as shown at 30 and 32 can either be formed only in the area adjacent the slit or they could pass entirely around the circumference of the tube. In this way, the grouting material 36 would extend around the circumference of the tube. This aspect of the present invention and the advantages thereof are described in the published PCT Application No. WO99/50531 discussed above; the entire subject matter of that document being incorporated herein by reference.

Figure 2:
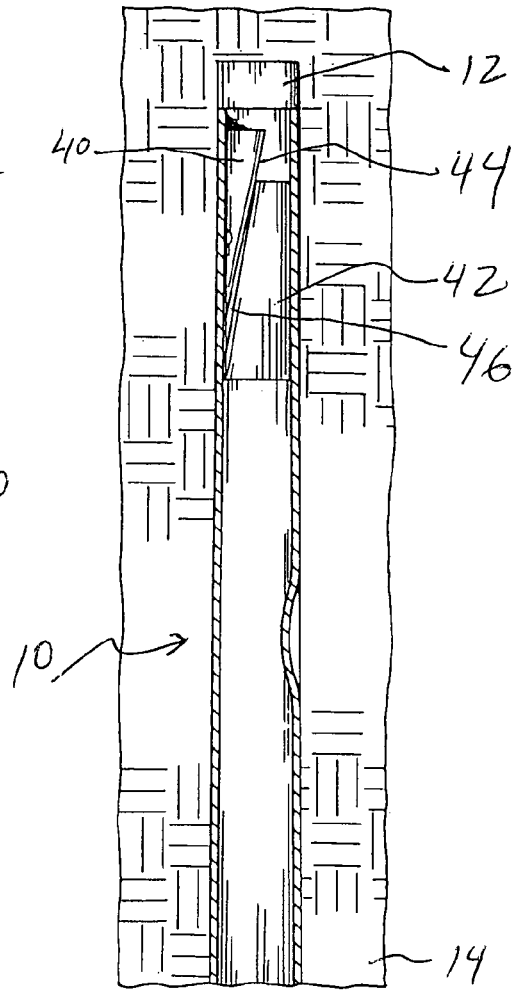
FIG. 2 is a partial cross sectional view of the upper portion of FIG. 1 showing the details of the distal end of the rock stabilizer.
Figure 4:
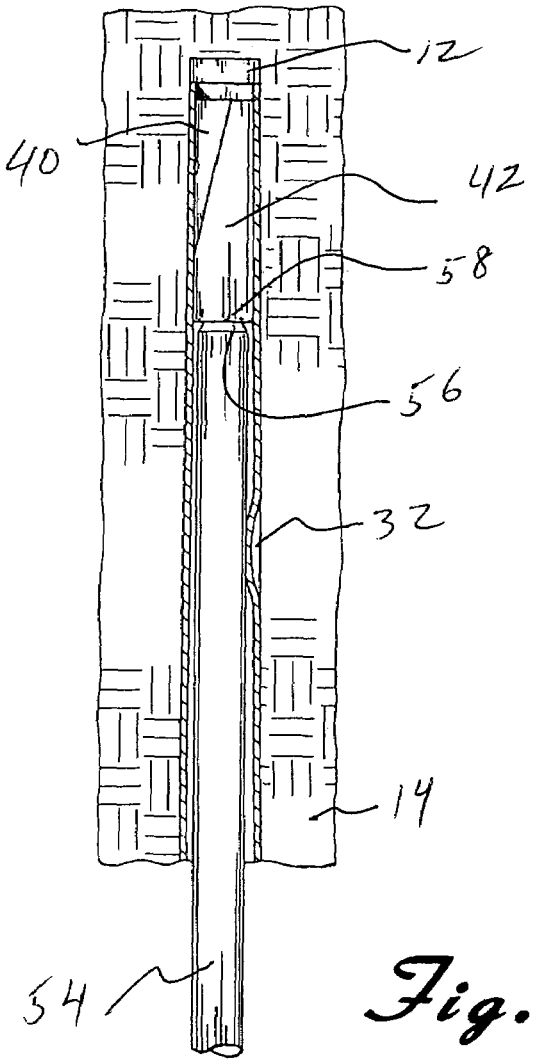
FIG. 4 is a partial cross sectional view of the upper portion of the distal end of the rock stabilizer similar to FIG. 2 but showing the expander wedge being actuated.

Located within the interior 18 adjacent the distal end 22 of the tube 16 is an expandable wedge mechanism 38. The expandable wedge 38 is comprised of two wedges 40 and 42 which include adjacent substantially planar inner wedge surfaces 44 and 46, respectively. As best shown in FIGS. 2 and 4, each of the wedges is elongated and also includes a curved outer surface that contacts a portion of the interior surface of the tube. The substantially planar inner surfaces are in contact with each other before and after they are actuated and the curved outer surfaces of the wedges contact the interior surface of the tube before and after they are actuated.

Figure 3:
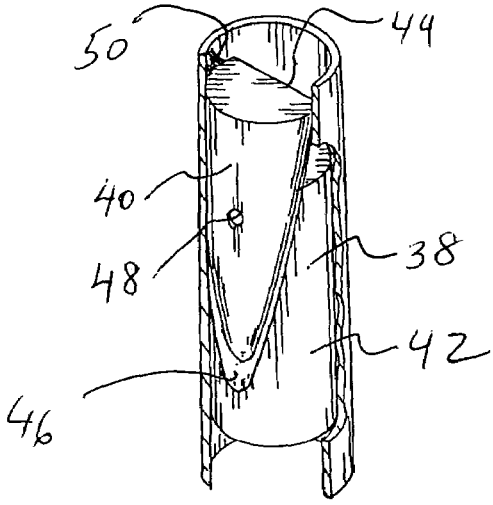
FIG. 3 is a top perspective view with portions broken away of the distal end of the rock stabilizer showing the details of the expander wedge.

The two wedge portions 40 and 42 are temporarily secured together preferably through the use of a shear pin 48 extending between the two. The upper wedge portion 40 is secured to the interior wall of the tube 16 preferably by a weld or the like which is shown at 50. The outer diameter of the combined expandable wedge 38 when in the unexpanded position such as shown at FIG. 3 is approximately the same as the inside diameter of the tapered distal end 22 of the tube 16. This is most clearly shown in FIG. 2.

After the rock stabilizer 10 is driven into the bore 12 and is properly positioned as shown in FIG. 2, an elongated rod such as shown at 52 in FIG. 4 is then forced into the interior of the tube 16. The upper end 56 of the rod 54 engages the lowermost surface 50 of the lower wedge portion 42. As the rod 54 is forced upwardly, the wedge portion 42 moves upwardly and eventually breaks the shear pin 48. As the wedge 42 continues to move upwardly, and since the wedge portion 40 is secured in place, the diameter of the expandable wedge 38 increases thereby expanding the wall of the tube 16 at the distal end thereof to anchor the rock stabilizer 10 in place.

Once the wedge 38 has expanded and has properly anchored the rock stabilizer 10 in place, the rod 52 is removed and grout or similar material 34 is then forced into the interior as shown in FIG. 5 so as to fill the same and extrude into the spaces around the indentations 30 and 32 as discussed above. Installation of the rock stabilizer 10 is, thus, completed.

The present invention may be embodied in other specific forms without departing from the spirit or essential attributes thereof and accordingly, reference should be made to the appended claims rather than to the foregoing specification as indicating the scope of the invention.

We claim:

1. A rock stabilizer comprising:

an elongated substantially cylindrically shaped metal tube having and interior and an exterior surface and including a distal end and a proximal end, said distal end being tapered so that the extreme distal end is initially smaller in diameter than the remaining portions of said tube, a flange located adjacent said proximal end, said tube further including only a single slit running substantially the entire length thereof, said tube being capable of being positioned within a bore formed in the wall of a mine;

a plurality of indentations or recesses formed in the exterior surface of said tube along the length thereof adjacent said slit whereby grout or resinous material pumped into said interior of said tube can flow out of said slit and into said plurality of indentations or recesses, said plurality of indentations or recesses being spaced apart from each other and being located at a plurality of different axial positions along the length of said tube, and wedge means located within said interior of said tube adjacent said distal end, said wedge means being actuatable from said proximal end after said stabilizer is installed in a bore to expand said distal end so as to firmly anchor said stabilizer in said bore.

2. The rock stabilizer of claim 1 wherein said wedge means is formed of two wedges, at least one of which is capable of being moved toward the other within said distal end of said tube.

3. The rock stabilizer of claim 2 wherein one of said wedges is immovably fixed to said interior of said tube.

4. The rock stabilizer of claim 3 wherein said one wedge is welded to said interior of said tube.

5. The rock stabilizer of claim 3 including means for temporarily maintaining said two wedges together while they are in the interior of said tube and before they are actuated.

6. The rock stabilizer of claim 5 wherein said means for temporarily maintaining said two wedges together includes a shear pin extending between said two wedges.

7. A rock stabilizer comprising:

an elongated substantially cylindrically shaped metal tube having and interior and an exterior surface and including a distal end and a proximal end, said distal end being tapered so that the extreme distal end is initially smaller in diameter than the remaining portions of said tube, a flange located adjacent said proximal end, said tube further including a slit running substantially the entire length thereof, said tube being capable of being positioned within a bore formed in the wall of a mine;

wedge means located within said interior of said tube adjacent said distal end, said wedge means being actuatable from said proximal end after said stabilizer is installed in a bore to expand said distal end so as to firmly anchor said stabilizer in said bore, said wedge means being formed of two wedges, one of which is welded to said interior of said tube and the other is capable of being moved toward said fixed wedge, each of said wedges being elongated and including a curved outer surface that contacts a portion of the interior surface of said tube and a substantially planar inner surface, the substantially planar inner surfaces of said wedges being in contact with each other before and after they are actuated and said curved outer surfaces of said wedges contacting the interior surface of said tube before and after they are actuated.

* * * * *